US005676158A

United States Patent [19]

Katzman et al.

[11] Patent Number: 5,676,158

[45] Date of Patent: Oct. 14, 1997

[54] TRACTION AND STRETCHING DEVICE

[75] Inventors: Stuart Katzman, 1624 E. Capitol Expressway, San Jose, Calif. 95121; Ric Ryan, San Jose, Calif.

[73] Assignee: Stuart Katzman, San Jose, Calif.

[21] Appl. No.: 744,029

[22] Filed: Nov. 5, 1996

[51] Int. Cl.[6] ..... A61G 15/00

[52] U.S. Cl. ..... 128/845; 602/36

[58] Field of Search ..... 128/845, 846, 128/877, 878, 879, 882; 602/32–40

[56] References Cited

U.S. PATENT DOCUMENTS

| | | | |
|---|---|---|---|
| 2,633,124 | 3/1953 | Yellin | 602/36 |
| 2,633,125 | 3/1953 | Yellin | 602/36 |
| 2,831,482 | 4/1958 | Cobb | 602/36 |
| 4,909,264 | 3/1990 | Wadsworth, III | 128/878 |

*Primary Examiner*—Michael A. Brown
*Attorney, Agent, or Firm*—The Kline Law Firm

[57] ABSTRACT

A traction and stretching device that is attached to a user's bed or table. The device includes an adjustable vertical upright that is used to change the position of the traction harness relative to the user. The vertical upright is contained in a housing assembly that includes stabilizer legs. The stabilizers are intended to be placed under the mattress of the user's bed, under a bed lying on the floor, or on a table. The device is secured by an anchor strap that is wrapped around the bed frame, post, or table leg cross support. Elastic cords (it has been found that bungee cords are an excellent choice) provide the traction force, and the user can vary the strength of the force by simply changing the position of his body. The elastic cords or a rope attached to the cords are/is color coded to allow the user to accurately reproduce work loads from use to use.

4 Claims, 3 Drawing Sheets

TRACTION AND STRETCHING DEVICE

FIELD OF THE INVENTION

The present invention relates generally to medical and health equipment, and more particularly is a traction and stretching device that can be used in a user's home.

BACKGROUND OF THE INVENTION

The benefits of traction devices have long been known to medical practitioners. While the procedure itself is fairly straightforward, there is generally some specialized equipment required to provide the necessary leverage and the appropriate angle of application of the traction force.

For this reason, there has been considerable activity in the prior art to provide traction devices that can be used by individuals without absolutely requiring their going to a medical facility. One such prior art device is the "TRACTION DEVICE" of Lyle, et al., U.S. Pat. No. 4,114,611, issued Sep. 19, 1978. This device utilizes a tubular frame with telescoping sides that the patient lies inside while applying traction. A free end of a strap is pulled to the desired tension to establish the traction force. The patient cannot see the provided scale, and thus at least two people are required to operate the device.

Another traction device is the "CERVICAL TRACTION DEVICE" of Goodley, U.S. Pat. No. 4,407,274, issued Oct. 4, 1983. This device requires the user to apply the traction with his feet. Because the user must necessarily flex his legs to apply the traction, the device is not suitable for applying traction to the low back, as the user cannot be in a supine position.

Still another device is the "SELF APPLICABLE SPRING LOADED PELVIC TRACTION DEVICE" of Gorsen, U.S. Pat. No. 4,865,022, issued Sep. 12, 1989. This device again uses a force applied by the user with his feet. Moreover, it utilizes a C-clamp connection to a bed, which with most bed constructions is difficult if not impossible. Because of the complexity of the device, it too requires at least two people to use the device.

For an in-home traction device to be of practical use, it must be fairly compact and easy to use. To gain widespread acceptance, the device must be effective in applying the traction force, and must not be too expensive. Furthermore, it must be versatile in its applications and installations.

Accordingly, it is an object of the present invention to provide an in-home traction device that a user can anchor on common household objects, such as a bed or table.

It is a further object of the present invention to provide a traction device that allows a traction force to be easily applied, and that is versatile enough so that the user can use the device in a supine, prone, or side-lying position.

It is another object of the present invention to provide a device that is inexpensive to manufacture.

It is a still further object of the traction device of the present invention to enable a user to provide variable traction force to his needs, and to have the traction force applied at the appropriate angle.

SUMMARY OF THE INVENTION

The present invention is a traction and stretching device adapted to be attached to a user's bed for traction applied to the low back. The device may also be affixed to any large table or affixed to any stationary object for use on the floor. The device includes an adjustable vertical upright that is used to change the angle from which the traction force is applied relative to the user. The vertical upright is contained in a housing assembly that includes stabilizer legs. The stabilizers are intended to be placed under the mattress of the user's bed, under a bed lying on the floor, or on a table. The device is secured by an anchor strap that is wrapped around the bed frame, post, or table leg cross support. Elastic cords (it has been found that bungee cords are an excellent choice) provide the traction force, and the user can vary the strength of the force by simply changing the position of his body. The elastic cords or a rope attached to the cords are/is color coded to allow the user to accurately reproduce work loads from use to use.

An advantage of the present invention is that it can be securely installed on items that are found in nearly all homes, office and clinics.

Another advantage of the present invention is that it is quite simple and easy to use, as the user can put on and take off the device without assistance.

A still further advantage of the present invention is that it is flexible in its applications, being useful for applying low-back traction as well as cervical traction, and allows the user to apply traction with the user in supine, prone, and side-lying positions.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
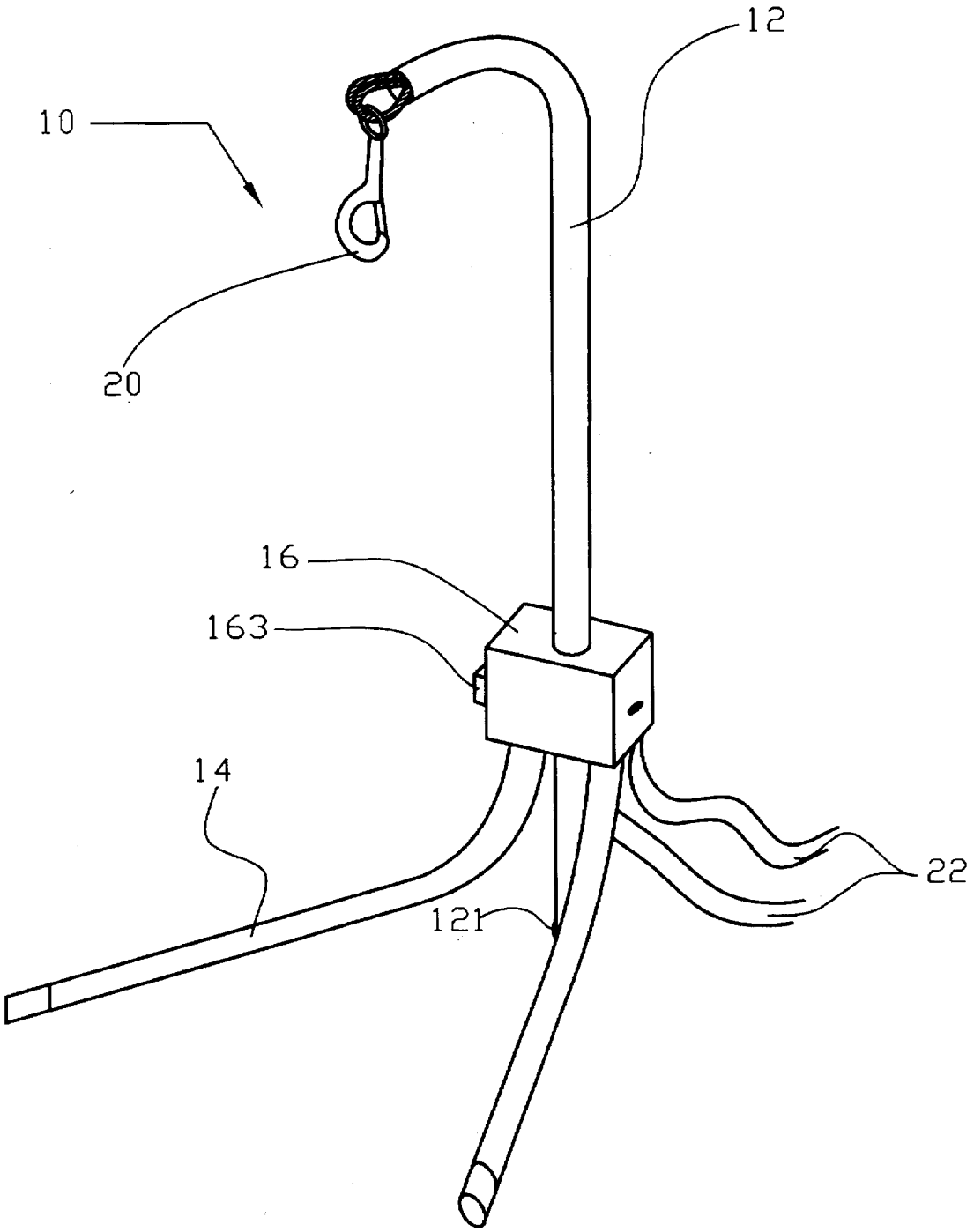
FIG. 1 is a perspective view of the traction and stretching device of the present invention.

The present invention is a traction and stretching device 10. The device 10 comprises an adjustable vertical upright 12 and two stabilizer legs 14 that are secured in a housing 16. A set of elastic cords, bungee cords 18, are contained in an interior of the vertical upright 12. At a distal end of the bungee cords 18, a swivel clasp 20 is affixed. An anchor strap 22 is provided to secure the device 10 in position.

Figure 2:
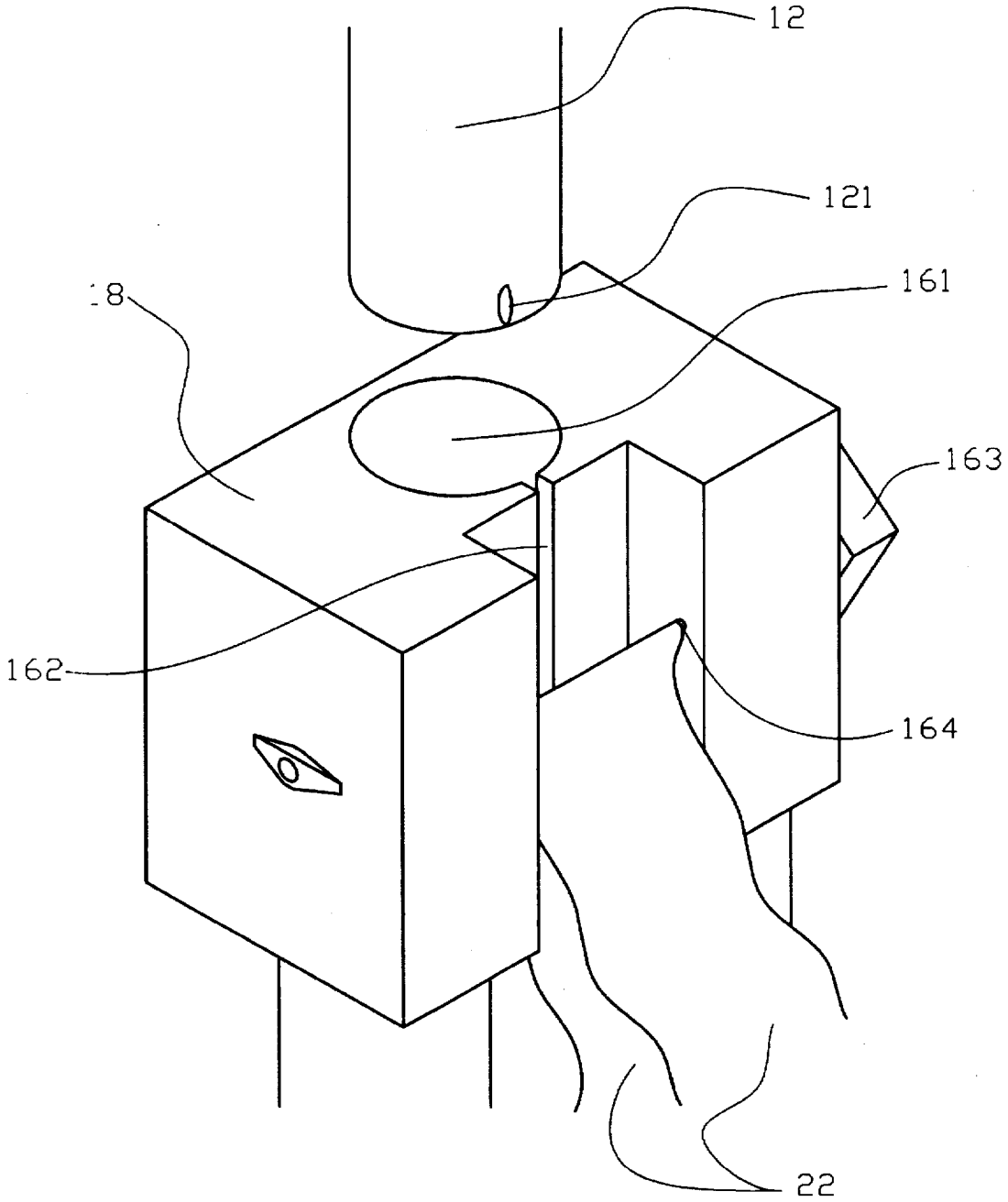
FIG. 2 is a detailed view of the housing of the device.

Referring now to FIG. 2, the housing 16 includes a throughway 161 that receives a lower end of the vertical upright 12. An open groove 162 in the throughway 161 receives a projecting end tab 121 affixed to the lower end of the vertical upright 12.

The housing 16 further includes means to secure the vertical upright 12 in place. In the preferred embodiment, the fixing means is a tension knob 163. The tension knob 163 is affixed to a threaded shaft 164 such that pressure can be applied to the housing 16. This constricts groove 162, thus tightening the throughway 161 and inhibiting movement of the vertical upright 12 within the throughway 161.

The threaded shaft 164 also serves as an attachment means for the anchoring strap 22. The anchoring strap 22 is used to secure the device 10 to the bed frame, table, or other stationary object, depending upon where the device is being mounted.

The stabilizer legs 14 can be inserted into the housing 16, or the stabilizer legs 14 and the housing 16 can be manufactured as an integral unit. The stabilizer legs 14 are intended to provide a stable base for the device by providing a means to counteract the traction force.

Figure 3:
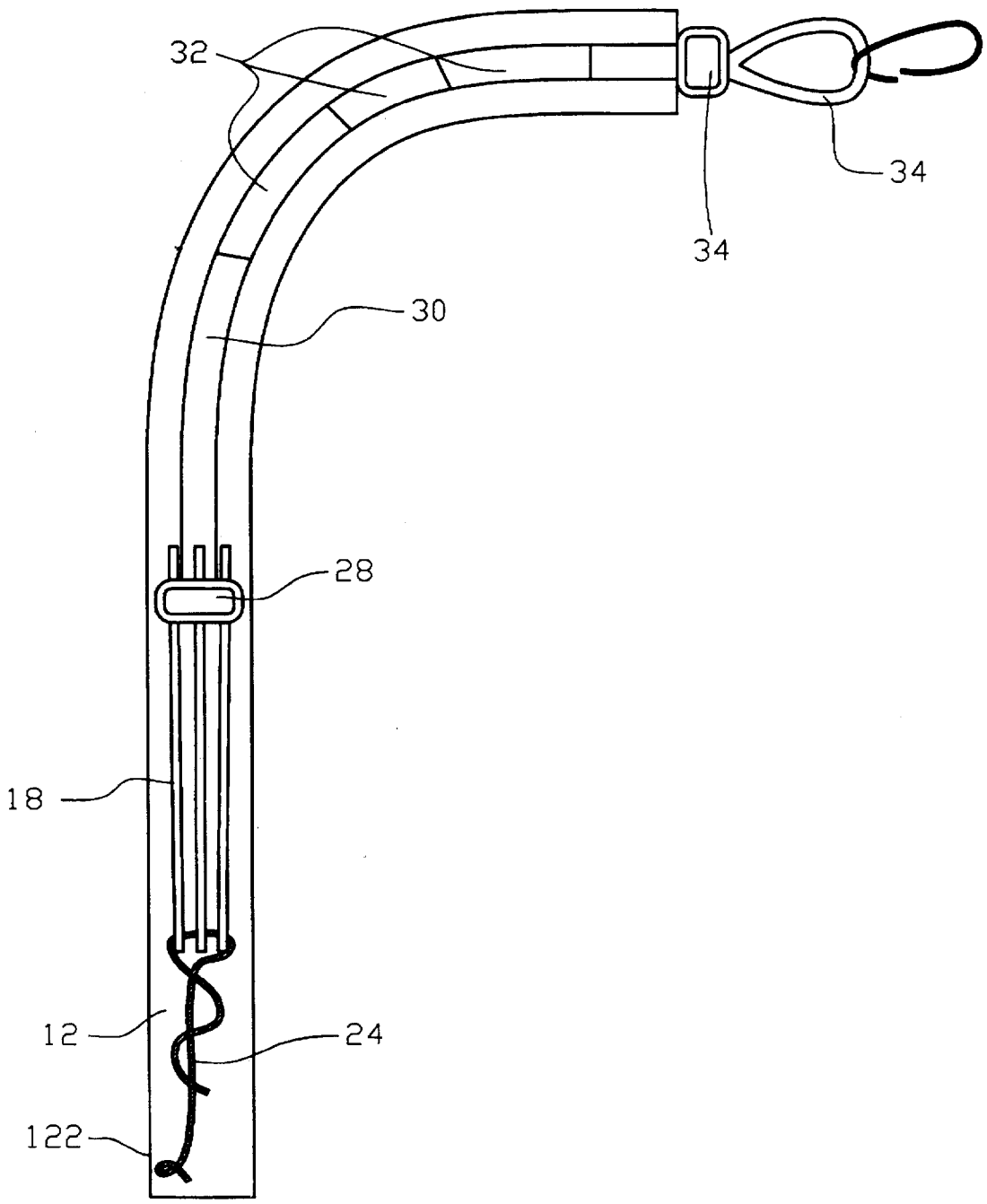
FIG. 3 is a cross section view of the vertical upright showing the bungee cord connection.

Referring now to FIG. 3, the bungee cords 18 are secured within the interior of the vertical upright 12. A bungee affixing means 24 is used to affix the bungee cords 18 at or near the base of the vertical upright 12. In the preferred embodiment, a wire is simply passed through a hole 122 in the vertical upright and attached to a first end of the bungee cords 18. As is clear from FIG. 3, any number of elastic cords can be used to provide the tension in the device.

A relatively non-elastic rope 30 is affixed to a second end of the bungee cords 18 by an affixing means 28. The rope 30 has color-coded segments 32 with an anchor means 34 attached to a distal end of the rope 30 via another affixing means 28. The anchor means 34 provides a convenient connection mechanism for the swivel clasp 20.

The user can determine the amount of traction that is being applied by the device by noting which color segments 32 are extended from the vertical upright 12. By extending the rope 30 so that a given color segment 32 is revealed, the user can accurately reproduce a given traction force with each use.

The device 10 is assembled by first affixing the stabilizer legs 14 to the housing 16. (If the legs 14 are integral to the housing 16, this step is clearly not required.) The vertical upright 12 is inserted into the throughway 161, the end tab 121 of the vertical upright 12 sliding through the groove 162. After the end tab 121 passes through the housing 16, the vertical upright 12 is twisted in the throughway 161 so that the end tab 121 no longer aligns with the groove 162. This ensures against the vertical upright 12 inadvertently being pulled out of the housing 16.

Following assembly of the device, the user installs it by (presuming traction or stretching is to be performed on the user's bed, envisioned to be the most common usage) first positioning the device 10 so that the stabilizer legs 14 are secured under the mattress of the user's bed. The anchor strap 22 is then secured to the bed frame or leg to ensure that the device 10 does not move during use. The user places the vertical upright 12 at the desired height, and secures it by tightening the tension knob 163. A traction harness is placed in position around the user's waist, and is secured to the swivel clasp 20.

To apply traction, the user then simply positions his body so that the desired amount of tension is applied through the bungee cords 18. To increase the traction force, the user simply moves himself away from the foot of his bed so that the tension in the bungee cords 18 is increased. To decrease the traction force, the user simply slides himself toward the device 10.

If the device is to be used with the stabilizer legs resting on the floor, the device is installed similarly. However, during assembly of the device 10, the vertical upright 12 is inserted into the throughway 161 from an underside of the housing 16. This reduces the angle between the swivel clasp 20 and the floor, so that the proper angle is provided to apply traction. The user affixes the strap 22 to a stationary object, and the user lies on the floor and moves away from the stationary object to create the traction force.

If the user wants to use the device on a table, the stabilizer legs 14 are simply placed on the surface of the table. The anchor strap 22 is then secured to a cross support member to ensure that the device is held in place.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A portable traction and stretching device comprising:

an adjustable vertical upright, means to fix said vertical upright at a given vertical position, at least one stabilizer leg, a housing, an anchor means, and at least one elastic cord with a harness affixing means at a distal end thereof, wherein;

said elastic cord is contained in an interior of said vertical upright, said vertical upright and said stabilizer leg are contained in said housing, said stabilizer leg is substantially perpendicular to said vertical upright so as to counteract a traction force, said anchor means is adapted to be affixed to a secure object to ensure that said device does not move during the application of the traction force; such that a user applies said traction force by affixing a harness to said harness affixing means of said elastic cord and moving away from said device to increase said traction force, and moving toward said device to decrease said traction force.

2. The device of claim 1 wherein:

said housing includes a throughway that receives a lower end of said vertical upright, an open groove in said throughway receives a projecting end tab affixed to said lower end of said vertical upright; such that rotation of said vertical member in said throughway is inhibited until said end tab passes through a body of said housing, said end tab thereafter prohibiting said vertical member from passing through said throughway of said housing.

3. The device of claim 1 wherein:

said means to secure said vertical upright at a given vertical position comprises a tension knob, said tension knob is affixed to a threaded shaft such that pressure can be applied through said means to secure said vertical upright to constrict a groove and a throughway in said housing so that said vertical upright is secured at a given position in said throughway.

4. The device of claim 1 wherein:

a rope is affixed between said elastic cord and said harness affixing means, said rope includes color-coded segments so that said user determines the amount of traction that is being applied by the device by noting which of said color-coded segments are extended from the vertical upright, thereby enabling said user to accurately reproduce a given traction force with each use of said device.

* * * * *